US007388551B2

(12) United States Patent
Guidon et al.

(10) Patent No.: US 7,388,551 B2
(45) **Date of Patent: *Jun. 17, 2008**

(54) ANTENNA SYSTEM

(75) Inventors: John Guidon, Thousands Oaks, CA (US); Gregg Fialcowitz, Northridge, CA (US)

(73) Assignee: Row 44, Inc., Westlake Village, CA (US)

( * ) Notice: Subject to any disclaimer, the term of this patent is extended or adjusted under 35 U.S.C. 154(b) by 43 days.

This patent is subject to a terminal disclaimer.

(21) Appl. No.: 11/426,901

(22) Filed: Jun. 27, 2006

(65) Prior Publication Data

US 2006/0232486 A1 Oct. 19, 2006

Related U.S. Application Data

(63) Continuation of application No. 10/900,020, filed on Jul. 26, 2004, now Pat. No. 7,068,235.

(51) Int. Cl.
*H01Q 19/06* (2006.01)
*H01Q 3/00* (2006.01)

(52) U.S. Cl. ..... 343/757; 343/754; 343/757; 343/763

(58) Field of Classification Search ..... 343/757, 343/754

See application file for complete search history.

(56) References Cited

U.S. PATENT DOCUMENTS 3,656,164 A 4/1972 Rempt
4,947,182 A 8/1990 Andersson
5,266,961 A 11/1993 Milroy
5,651,050 A 7/1997 Bhagat et al.
5,929,816 A 7/1999 Gross et al.
5,969,686 A 10/1999 Mackenzie
6,034,634 A 3/2000 Karlsson et al.
6,094,171 A 7/2000 Riddle et al.
6,201,509 B1 3/2001 Zhang et al.
6,201,797 B1 3/2001 Leuca et al.
6,208,304 B1 3/2001 Strickland
6,259,706 B1 7/2001 Shimada (Continued)

OTHER PUBLICATIONS

Patent Cooperation Treaty, PCT International Preliminary Report on Patenability, PCT/US2005/026324, date mailed Feb. 2, 2007, 5 pages.

*Primary Examiner*—Trinh V Dinh
(74) *Attorney, Agent, or Firm*—Thomas F. Lebens; Sinsheimer Juhnke Lebens & McIvor, LLP

(57) ABSTRACT

In some embodiments, the multiple antennas are cooperated in the system to provide simultaneous communication with multiple remote sites. Embodiments comprises a first variable inclined continuous transverse stub (VICTS) antenna that comprises a perimeter and an inactive region within the perimeter, a second VICTS antenna positioned at the inactive region of the first antenna, a first antenna control that steers the first antenna, and a second antenna control that steers the second antenna independent of the first antenna. In some embodiment, an antenna system is provided that comprises a first turntable having a perimeter, a first antenna having a perimeter, where the first antenna is secured on a first surface of the first turntable, a second antenna positioned proximate the first antenna and extending within the perimeter of the first turntable, where the second antenna is steerable independent of the first antenna.

20 Claims, 12 Drawing Sheets

U.S. PATENT DOCUMENTS

| | | | | |
|---|---|---|---|---|
| 6,447,152 | B1 | 9/2002 | Goebert | |
| 6,473,057 | B2 | 10/2002 | Monzon | |
| 6,643,510 | B2 | 11/2003 | Taylor | |
| 6,653,985 | B2 * | 11/2003 | Sikina et al. | 343/853 |
| 6,677,908 | B2 | 1/2004 | Strickland | |
| 6,741,841 | B1 | 5/2004 | Mitchell | |
| 6,919,854 | B2 | 7/2005 | Milroy et al. | |
| 7,068,235 | B2 * | 6/2006 | Guidon et al. | 343/757 |
| 2002/0080084 | A1 | 6/2002 | Strickland | |
| 2002/0087992 | A1 | 7/2002 | Bengeult et al. | |
| 2002/0118137 | A1 | 8/2002 | Halsema et al. | |
| 2002/0142717 | A1 | 10/2002 | Moriomoto | |
| 2002/0170060 | A1 | 11/2002 | Lyman | |
| 2002/0173305 | A1 | 11/2002 | Forman et al. | |
| 2003/0008611 | A1 | 1/2003 | Forman et al. | |
| 2003/0045231 | A1 | 3/2003 | Chapelle et al. | |
| 2003/0045286 | A1 | 3/2003 | Taylor | |
| 2003/0055975 | A1 | 3/2003 | Nelson et al. | |
| 2003/0097658 | A1 | 5/2003 | Richards | |
| 2003/0117327 | A1 | 6/2003 | Navarro et al. | |
| 2003/0142024 | A1 | 7/2003 | Carson | |
| 2003/0203717 | A1 | 10/2003 | Chuprun et al. | |
| 2003/0214454 | A1 | 11/2003 | Quagilaro | |
| 2005/0162325 | A1 | 7/2005 | Tietjen | |

* cited by examiner

ANTENNA SYSTEM

RELATED APPLICATION DATA

This application is a continuation of U.S. patent application Ser. No. 10/900,020 filed on Jul. 26, 2004, now U.S. Pat. No. 7,068,235, of John Guidon et al., for ANTENNA SYSTEM, which application is hereby fully incorporated herein by reference.

FIELD OF THE APPLICATION

The present application is directed generally toward wireless communication with antennas, and more specifically steerable antennas.

BACKGROUND

The use of and number of desired implementations for wireless communication is greatly expanding. To actually implement many implementations, complex, expensive and cumbersome antenna systems have to be utilized. Further, the available wireless communications can be limited because of the antenna.

Directional antennas are utilized in many applications and are often capable of being pointed, or 'steered' in a desired direction. There are many types and variations of directional antennas, including phased array, mechanically steerable, turntable mounted tiltable and non-tiltable flat plate, turntable mounted Lumberg lens, and other such antennas. These antennas each have many benefits. However, each of the identified antennas has limitations. For example, the utilization of these antennas for mobile communication can be complex and/or expensive. Additionally, some applications prevent the use of some of these antennas.

For example, the utilization of antennas on airplanes is often restricted because antennas needed to achieve desired implementations are excessively expensive and complex. Further, many antenna systems cannot be employed because of size restrictions and impracticality of operation.

SUMMARY

The present embodiments advantageously address the needs above as well as other needs by providing systems, apparatuses and methods for use in providing wireless communication. In some embodiments, multiple antennas are cooperated in the system to provide simultaneous communication with multiple remote sites.

Some embodiments provide an antenna that comprises a first variable inclined continuous transverse stub (VICTS) antenna that comprises a perimeter and an inactive region defined within the perimeter, and a second VICTS antenna positioned at the inactive region within the perimeter of the first VICTS antenna. The antenna further includes a first antenna control that cooperates with the first VICTS antenna to steer the first VICTS antenna, and a second antenna control cooperated with the second VICTS antenna to steer the second VICTS antenna independent of the first VICTS antenna.

In some embodiments, an antenna system is provided that comprises a first turntable having a perimeter, a first antenna having a perimeter, where the first antenna is secured on a first surface of the first turntable, a second antenna comprising a second turntable, and the second antenna is positioned proximate the first antenna such that at least a portion of the first antenna is positioned to extend within the perimeter of the first turntable, where the second antenna is steerable independent of the first antenna.

BRIEF DESCRIPTION OF THE DRAWINGS

The above and other aspects, features and advantages of the present embodiments will be more apparent from the following more particular description thereof, presented in conjunction with the following drawings wherein.

Figure 1:
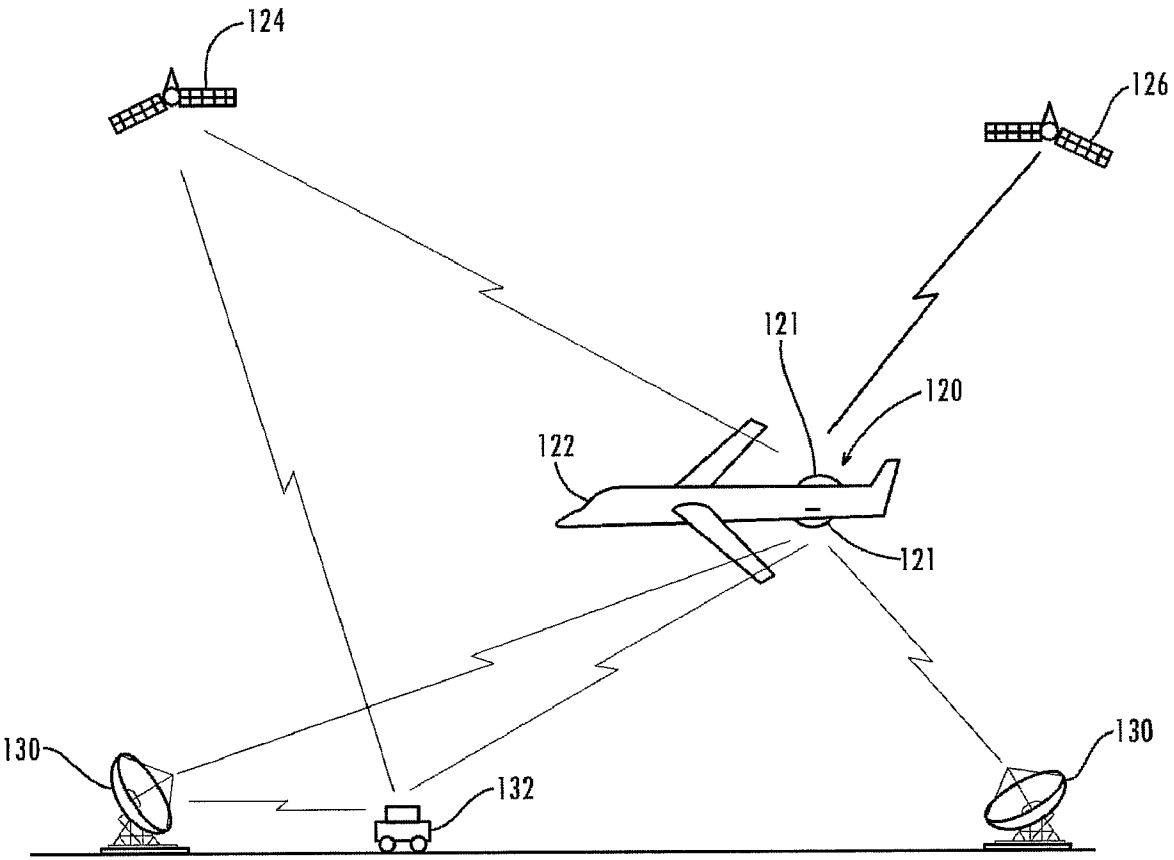
FIG. 1 depicts an overhead view of a communication system according to some present embodiments mounted on mobile vehicles.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The present embodiments provide systems, apparatuses and methods for wirelessly communicating information and/or data. In some embodiments, the antenna systems include a plurality of antennas providing wireless communication with different remote receivers. Further, some embodiments are constructed with low profiles so that they can be employed on moving vehicles with limited drag. For example, some preferred implementations provide antenna systems mounted on airplanes to allow simultaneous wireless communication with multiple, remote communication systems, such as satellites.

FIG. 1 depicts an overhead view of a communication system 120 according to some present embodiments mounted on an airplane 122. The communication system 120 allows wireless communication with one or more remote communication devices, such as a plurality of satellites 124, 126, ground stations 130, mobile devices (e.g., cars 132, ships, boats, and other mobile devices), and other relevant communication devices. In some preferred implementations, the communication system 120 allows simultaneous communication with multiple satellites from a single antenna system. In further embodiments, the systems allow communication to multiple ground stations and/or mobile devices. Multiple communication systems 120 are employed in some implementations to achieve desired communication coverage. For example, a first system can be mounted on an upper surface of an airplane to communicate with satellites, while a second system is mounted on a lower side of the airplane to communicate with ground stations.

Directional antennas provide many useful properties including power gain, ability to reject unwanted signals from unwanted directions, and can be employed with steerable applications in tracking either moving or stationary targets from either stationary or moving platforms. There are many types and variations of directional antennas, such as phased array, mechanically steerable, turntable mounted tiltable and non-tiltable flat panel, turntable mounted Lumberg lens, and other such antennas.

Phased array antennas have the benefit of being able to track multiple targets or produce multiple beams from a single antenna. These antennas, however, are typically expensive to manufacture due, at least in part, to the large numbers of expensive delay element components. Further, phased array antennas often have inferior gain performance per unit area due to losses within successive delay elements. The implementations of phased array antennas can also be limited because they are typically heavy and bulky.

There are many types of mechanically steerable antennas. Gimbal mounted parabolic antennas are one example. Typically, parabolic antennas are fairly large relative to the performance, and are generally spherically swept volumes and/or cubical in their physical dimensions. Although these antennas provide relatively good performance, the implementation is limited due to the size and/or shape. For example, their uses in portable or mobile applications are limited (e.g., antennas to be mounted on aircraft generally require a low profile in the vertical extent, to avoid aerodynamic issues). Further, single parabolic antennas have only single beam.

Turntable mounted tiltable flat plate antennas are vertically extended or extended in the elevation dimension because these antennas typically require a large flat plate to be tilted to adjust the elevation of their beam. They are also limited to a single beam. Turntable mounted non-tiltable flat plate antennas are less useful because they lack the capability to steer the beam in elevation. Turntable mounted Lumberg lens antenna configurations incorporate refractive devices of radiated refractive index. However, these devices are typically both time consuming to manufacture and install, and relatively expensive to manufacture. Further, these devices are generally heavy and some what limited in the elevation extension, and are also limited to a single beam.

Alternatively, continuous transverse stub (CTS) antennas are relatively flat, planar antennas that have relatively very thin profiles and are typically lightweight. Further, CTS antennas are generally durable, allow for dual-polarization, and are applicable at a relatively wide range of frequencies. Variable inclined continuous transverse stub (VICTS) antennas provide similar advantages as CTS antennas while providing the enhanced capability to steer the beam in elevation, allowing tracking and other benefits.

Figure 2:
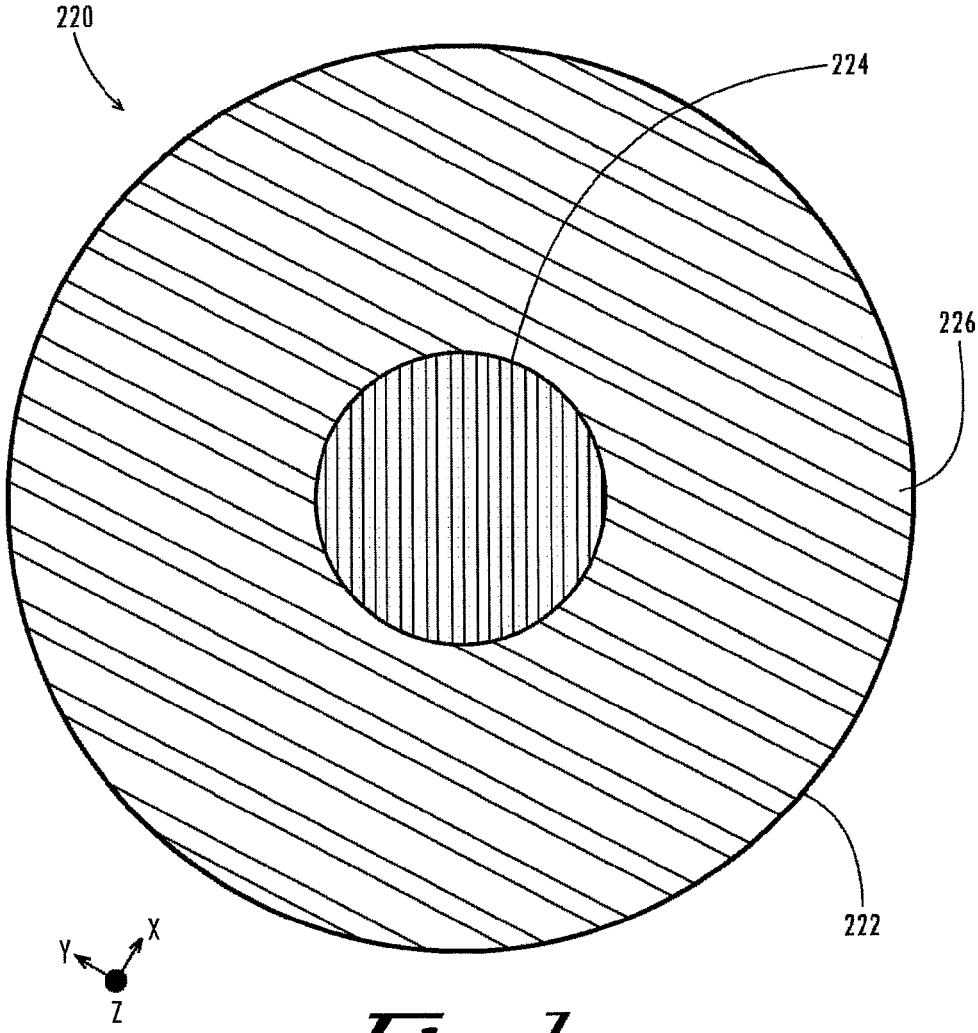
FIG. 2 depicts a simplified, block diagram overhead view of an antenna system according to some present embodiments.

FIG. 2 depicts a simplified, block diagram overhead view of an antenna system 220 according to some present embodiments. The antenna system includes a first antenna 222 with a second antenna 224 positioned within an area defined by the perimeter of the first antenna 222. In some embodiments, the first and second antennas are continuous transverse stub (CTS) antennas, and in some preferred embodiments, the first and second antennas are variable inclined continuous transverse stub (VICTS) antennas that are substantially planar to reduce the antenna system profile. The antenna system 220 of FIG. 2 shows the first and second antennas arranged generally in a concentric orientation. However, eccentric configurations can also be employed as is fully described below with reference to FIG. 10.

Still referring to FIG. 2, the first antenna 222 is implemented with a series or plurality of transverse stubs 226, typically arranged in a parallel fashion, however other arrangements can be utilized. The continuous transverse stub elements 226 can be arrayed to form planar apertures and structures comprised of an array of continuous transverse stub elements fed by a line-source or sources (not shown). The transverse stub elements 226 can be varied by modifying the height, width, length, and cross section over the antenna. The number of stub elements can also be varied to provide desired implementation.

The second antenna 224 is positioned within a perimeter of the first antenna 222. Positioning the second antenna within the perimeter of the first antenna, at least in part, reduces the total size and footprint of the antenna system 220. In some embodiments, the first antenna is constructed with an inactive region 320 (see for example, FIGS. 3 and 4) at which the second antenna 224 is positioned.

Figure 3:
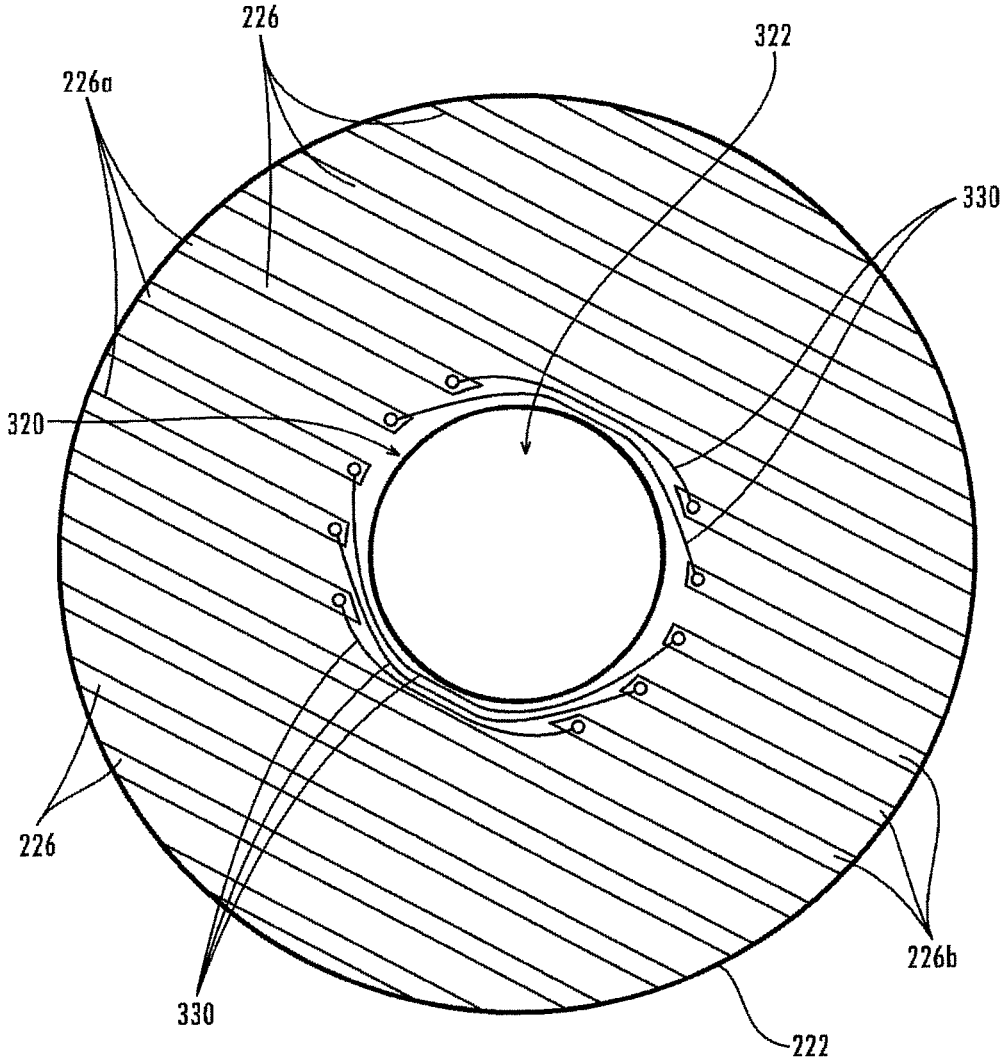
FIG. 3 depicts an overhead view of the first antenna with the inactive region defined by a hole or aperture in the first antenna.

FIG. 3 depicts an overhead view of the first antenna 222 with the inactive region 320 defined by a hole or aperture 322 in the first antenna. Because of the hole 322, the transverse stub elements 226 do not extend across the antenna, but are interrupted. In some preferred embodiments, the first antenna 222 further includes non-radiating conductors 330 that electrically couple the two portions or sections 226*a* and 226*b* of each stub separated or interrupted by the inactive region 320. The non-radiating conductors 330 can be substantially any relevant conductor capable of electrically coupling the two portions of the separated stubs, and preferably provides delay matching so that the phase of the signal fed to the separated stub portions 226*a* and 226*b* is correctly controlled in such a manner as to cooperate with the stubs in the rest of the antenna. Note that the conductors may delay the signals by multiple periods of the radiated signal, as long as the phasing is correct. Such conductors may be made in many types (e.g., coaxial cable, strip line, waveguide, and other such conductors).

Further, the non-radiating conductors 330 can be configured in substantially any relevant configuration such that they are non-radiating and thus maintain the inactivity of the inactive region 320. For example, non-radiating matched delay conductors can be routed, wrapped and/or etched around the perimeter of the hole defining the inactive region 320. In some embodiments, the non-radiating conductors 330 are extended under the second antenna 224. Alternatively, the non-radiating conductors can be bundled and routed over the second antenna. Other configurations can also be employed to couple the two portions of the interrupted stubs.

Figure 4:
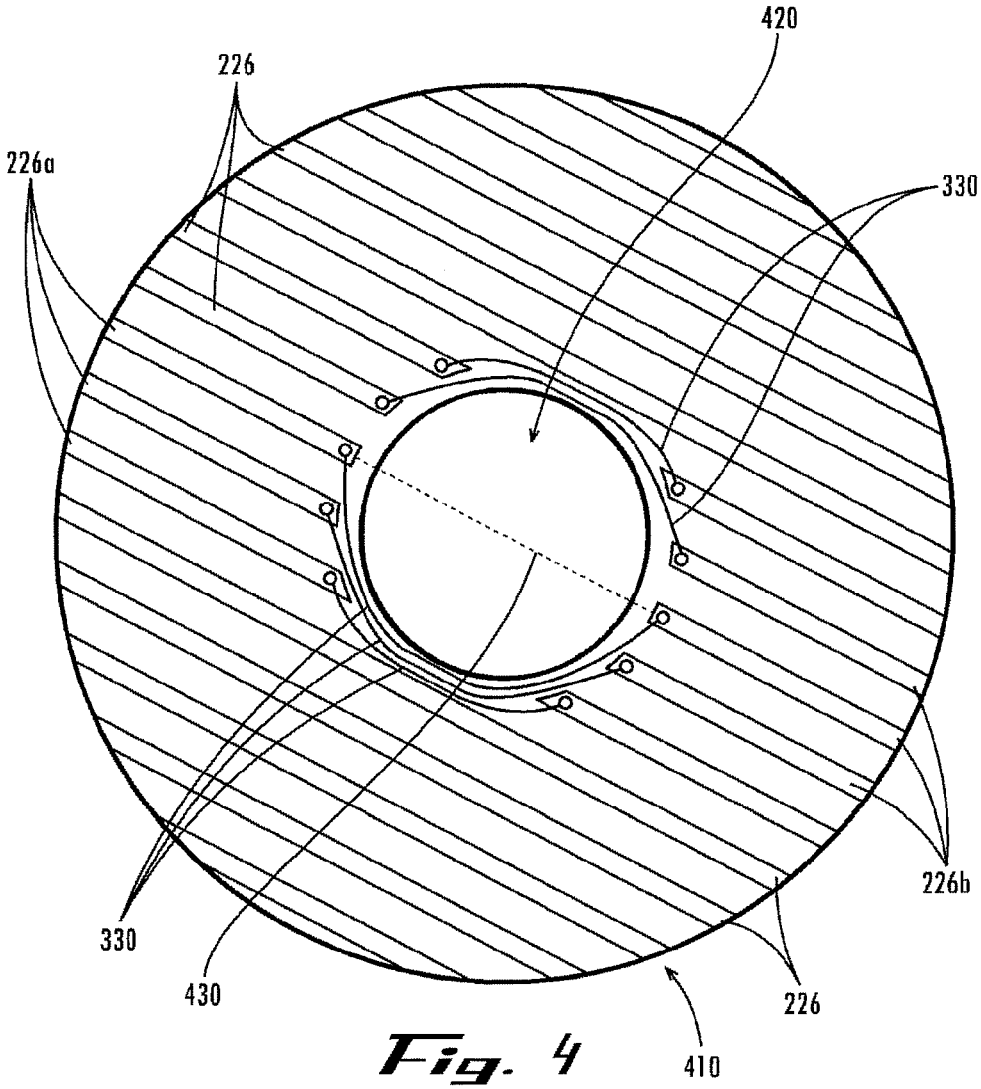
FIG. 4 depicts an overhead view of an antenna, according to an alterative embodiment, where an inactive region is defined by interrupting transverse stubs.

FIG. 4 depicts an overhead view of an antenna 410, according to an alterative embodiment, where an inactive region 420 is defined by interrupting at least some of the transverse stubs 226 into two parts or section 226*a* and 226*b* separated by a gap, where the gaps between the portions of the interrupted stubs define the inactive region 420. Non-radiating conductors 330 couple between portions 226*a* and 226*b* of the interrupted stubs 226 to electrically couple the two portions. Again, the non-radiating conductors can be routed on the upper or lower surface of the antenna 410, through or between planes of the antenna, and/or optionally under a second antenna 430 (shown in dashed line).

Referring back to FIG. 2, in some preferred embodiments, the first antenna 222 is steerable independent of the second antenna 224, and similarly, the second antenna is steerable independently of the first antenna. The antennas are configured to allow the adjustment of one or more antenna conditions and/or characteristics to achieve the desired signal transmission and/or reception quality, and in a desired direction. In some embodiments, the antenna steering is implemented, at least in part, by providing mechanisms for adjusting one or more of the azimuth, the elevation and/or the polarization of the each of the antennas. Providing independent steering allows the system 220 to simultaneously communicate with multiple remote communication sites. Further, the steering allows the antennas to be employed in situations where remote communication sites are to be tracked to maintain communication links (e.g., communicating with satellites).

Figure 5:
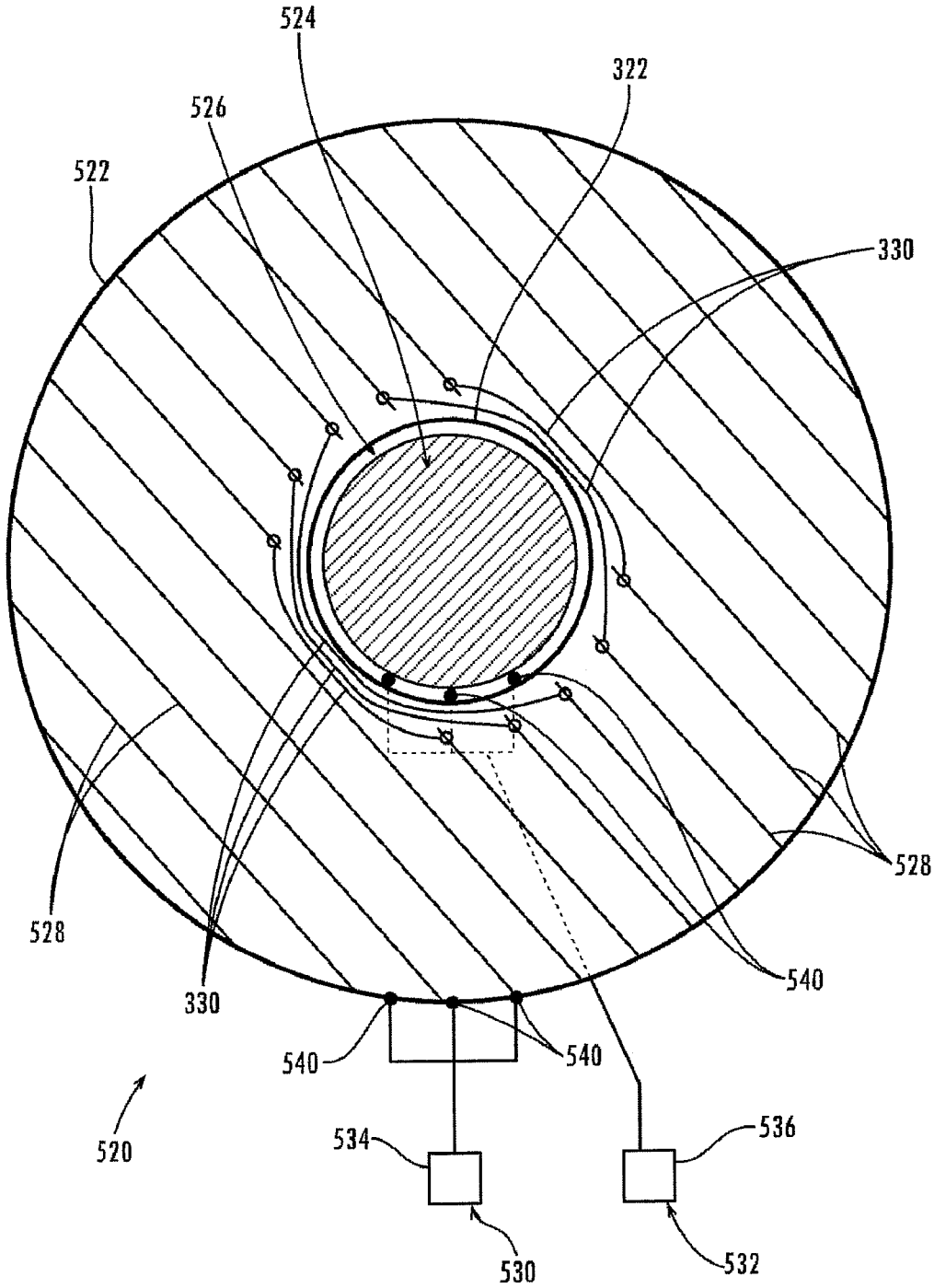
FIG. 5 depicts a communication system according to some embodiments that includes a first antenna with an inactive region defined by a hole or aperture in the first antenna.

FIG. 5 depicts a communication system 520 according to some embodiments that includes a first antenna 522 with an inactive region 526 defined by a hole or aperture 322 in the first antenna. Continuous transverse stubs 528 extend across the first antenna. A portion of the stubs are interrupted or split into two portions by the inactive region 526. Non-radiating conductors 330 are routed around the perimeter of the inactive region, and/or directly across the inactive region underneath a second antenna 524. The non-radiating conductors 330 are shown in FIG. 5 to be routed on the upper surface, however, these conductors can be routed on a lower surface, in between layers or planes of the antenna, under the second antenna 524 and other such configurations.

A second antenna 524 is positioned at the inactive region 526, with the first antenna 522 surrounding the second antenna. Steering systems 530, 532 are cooperated with each antenna 522, 524, respectively, to implement the steering of the antenna to achieve desired communication. Each steering system includes a steering controller 534 and 536. In some embodiments, a single controller directs the steering systems 530, 532 for each antenna. The steering systems further include mechanisms 540 for implementing changes to antenna characteristics to achieve the desired steering. In some embodiments, the steering mechanisms 540 include rotation drives (such as motor driven rods, drive shafts, and/or gears), electrical coupling for electronically controlling, and/or other such mechanisms and combinations thereof that cooperate with the antennas to implement the desired change(s) to antenna characteristics. The steering mechanisms provide electromechanical steering and/or electrical steering.

In some embodiments, the antennas 522, 524 are controlled by adjusting one or more of an azimuth and/or an elevation at which the antenna is directed. Additionally and/or alternatively, the antennas can be adjusted to transmit and/or receive according to a desired polarization. Some preferred embodiments adjust one or more of the characteristics of the antenna through rotation of the antenna and/or portions of the antenna.

Figure 6:
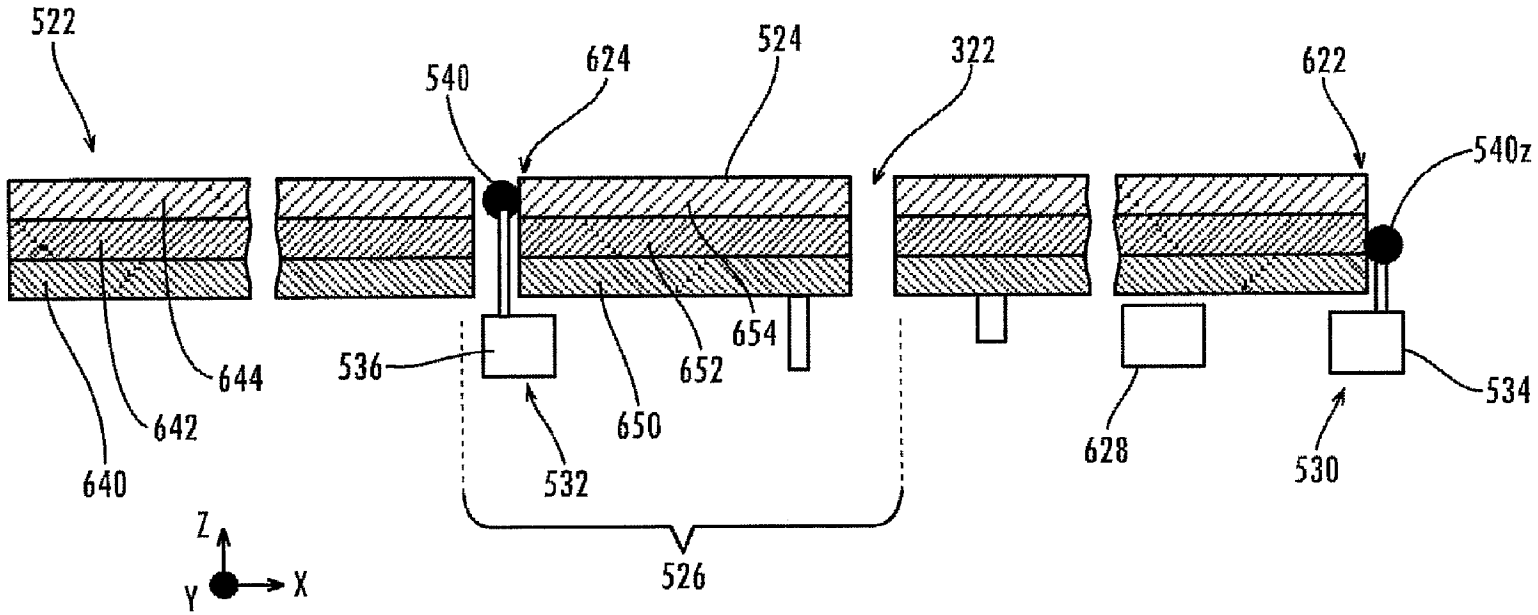
FIG. 6 depicts a simplified cross-sectional view of the communication system of FIG. 5.

FIG. 6 depicts a simplified cross-sectional view of the communication system 520 of FIG. 5 according to some embodiments. The first antenna 522 includes a hole or aperture 322 defining the inactive region 526 of the first antenna 522. The second antenna 524 is positioned at the inactive region and surrounded by the first antenna. Further, the second antenna is positioned a distance from the first antenna such that a steering mechanism 540 of a second steering systems 532 extends up into the hole 322 to cooperate with the second antenna 524. For example, a gear assembly or wheel is mounted on a rotating shaft, and is positioned in the hole 322 to couple with the perimeter 624 of the second antenna 524. The second steering system controller 536 controls the rotation of the steering mechanism 540 to implement a desired amount of rotation of the second antenna about the Z axis to adjust characteristic of the second antenna.

Similarly, a first steering system 530 cooperates with the first antenna 522. The first steering system can include a steering mechanism 540, such as a gear assembly or wheel, that couples with the perimeter 622 of the first antenna 522. The first steering system controller 534 controls the steering mechanism 540, for example, to rotation of the mechanism causing at least a portion of the first antenna to rotate adjusting a desired characteristic of the first antenna. One or more power and signal control units 628 couple with the first and second antennas to supply power to the antennas, to forward signals to be transmitted and/or retrieve signals received through the first and second antennas 522, 524.

Still referring to FIG. 6, in some embodiments, the first antenna 522 includes a turntable 640 that allows the antenna 522 to be rotated. The steering system 530 directs a first steering mechanism to rotate the turntable 640 to achieve, for example, a desired azimuth for the first antenna. An elevation of the first antenna is similarly controlled, in some implementations, by directing a second steering mechanism to rotate an elevation plane or layer 642. In some preferred embodiments, the first antenna 522 further includes a polarization plane 644 allowing the antenna to be adjusted to transmit and/or receive signals with predefined polarization. A third steering mechanism can couple with the perimeter of the polarization plane 644 to rotate this plane to achieve the desired polarization effects.

In some embodiments, the second antenna can similarly be configured with a turntable 650, an elevation plane 652, and/or a polarization plane 654. The second steering system 532 can also include, in some implementations, a separate steering mechanism (e.g., rotational drives, gears, and/or other mechanisms) for each plane (e.g., the turntable 650, elevation plane 652 and polarization plane 654), each controlled by the steering controller 536 to adjust the second antenna for a desired communication. The communication system 520 allows for independent steering of the first and second antennas 522 and 524, respectively, through the independent steering systems 530, 532 and steering mechanisms 540.

Figure 7:
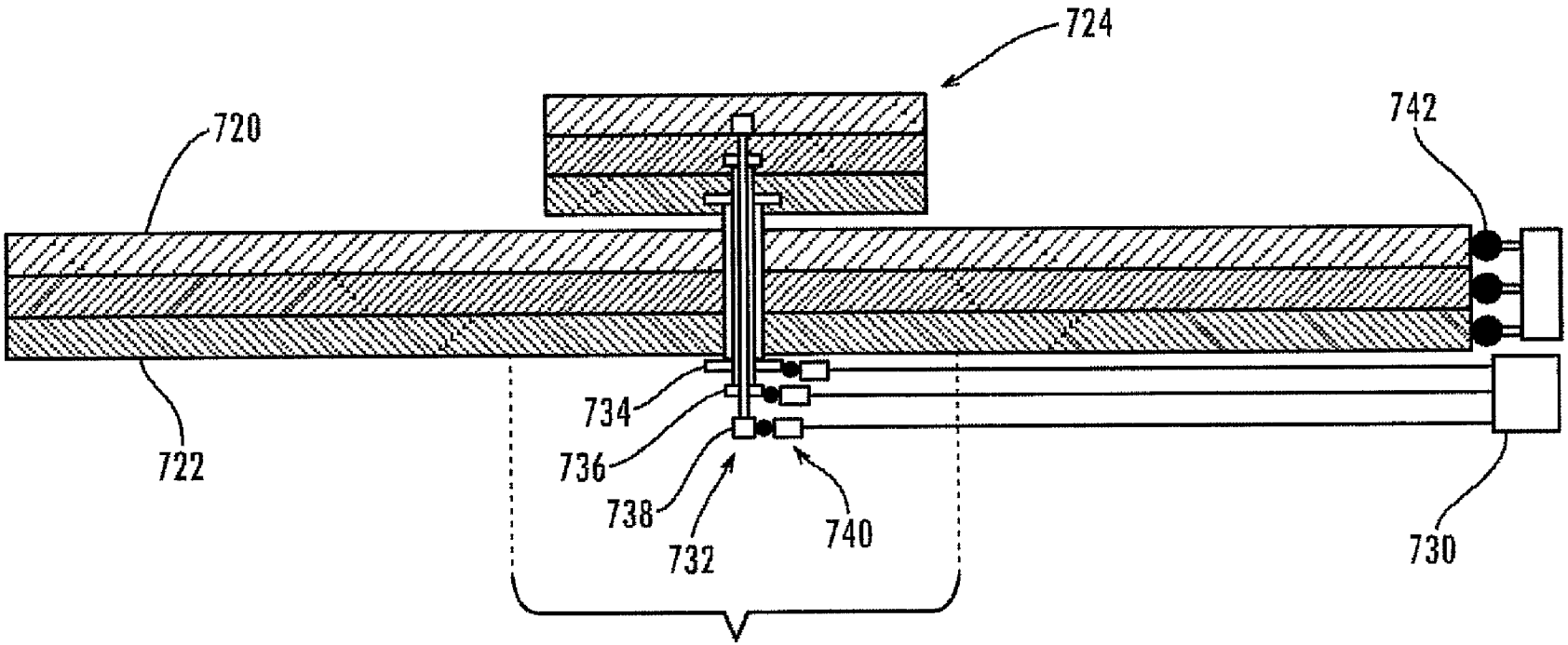
FIG. 7 depicts a simplified cross-sectional view of a communication system according to some present embodiments where the first antenna is configured similar to the antenna depicted in FIG. 4.

FIG. 7 depicts a simplified cross-sectional view of a communication system 720 according to some present embodiments where the first antenna 722 is configured similar to the antenna depicted in FIG. 4. The transverse stubs are interrupted with gaps between the portions of the stubs defining the inactive region 730. The system includes a coaxial bearing 732 in the center of the antennas extending through the first antenna 722 to cooperate with the second antenna 724. The coaxial bearing can include three gears 734, 736 and 738 that are coaxial, each spins outside the coaxial bearing to three steering mechanisms, such as motor drives 740. This allows the independent rotation of each plane of the second antenna 724 to implement desired steering and/or adjust characteristics of the second antenna 724. In some implementations, electrical power and/or signals can be supplied to one or more of the planes of the second antenna through the coaxial bearing 732. Alternatively and/or additionally, a spindle can extend up through the center of the first antenna 722 with the electrical coupling (power to the antenna, inbound and/or outbound signals) and rotational drives to provide rotation. A steering controller system 730 provides control for the drive mechanisms 740. The steering control system 730 or a separate control system can further provide control for drive mechanisms 742 to rotate the planes or layers of the first antenna 722.

Figure 8:
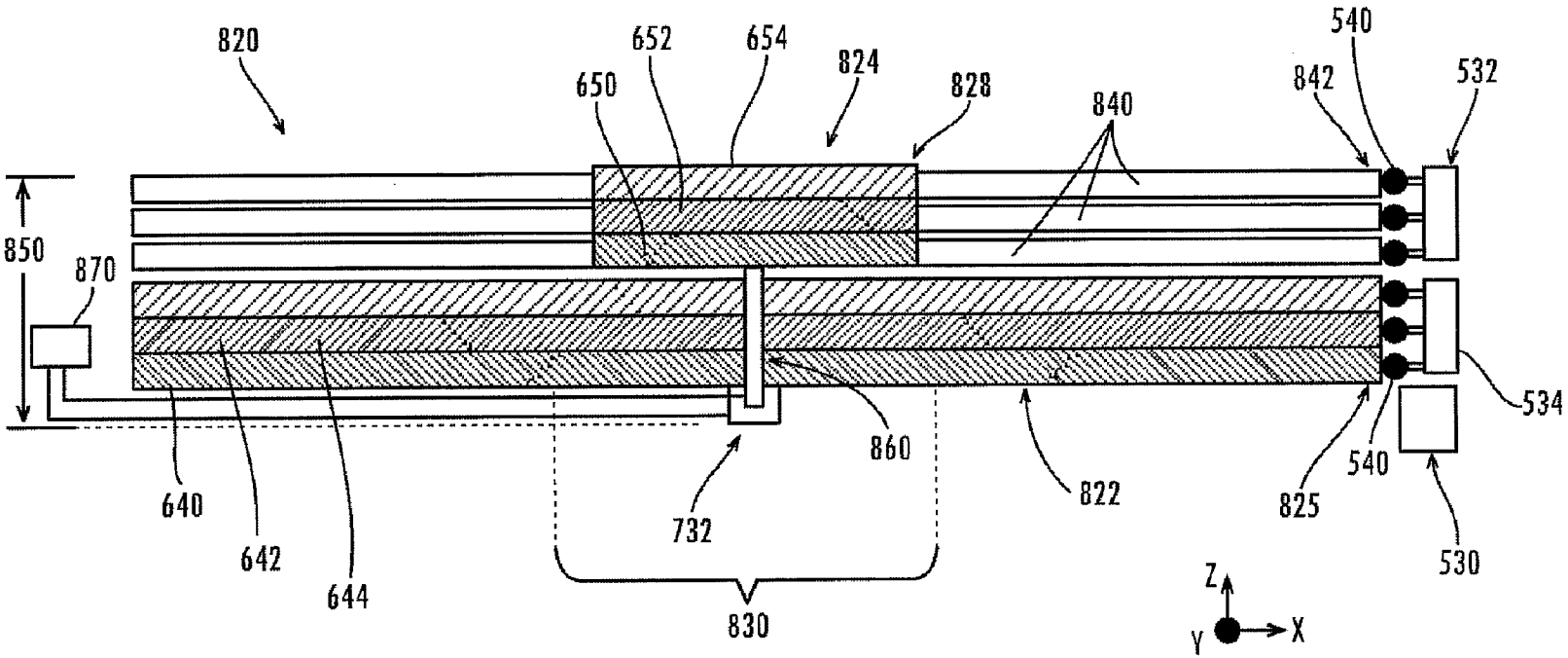
FIG. 8 depicts a simplified cross-sectional view of a communication system according to some present embodiments with first antenna and second antenna.

FIG. 8 depicts a simplified cross-sectional view of a communication system 820 according to some present embodiments with first antenna 822 and second antenna 824. The first antenna is configures similar to the antenna depicted in FIG. 4 with the inactive region 830 defined by interrupting or splitting some of the stubs of the first antenna 822 such that gaps exist between portions of the stubs establishing the inactive region 830 defined by the gaps. The second antenna 824 is positioned over the first antenna 822 at the inactive region 830 to limit interference with, and preferably avoid interfering with, the communication to and/or from the first antenna 822.

A first steering system 530 includes steering mechanisms 540, such as rotational drives. The steering mechanisms cooperate with the perimeter 825 of the first antenna 822 to rotate at least a portion of the first antenna about a Z axis. A first steering system controller 534 controls the rotation of the steering mechanism to rotate the first antenna to achieve the desired direction of transmission and/or reception, and/or polarization. Typically, more than one steering mechanisms 540 are employed to adjust different antenna characteristics. For example, the communication system 820 can include three steering mechanisms, one to control the positioning of a turntable 640, one to control an elevation plane 642, and one to control a polarization plane 644.

The second antenna 824 also includes multiple planes, such as a turntable 650, an elevation plane 652, and/or a polarization plane 654. In the communication system 820 of FIG. 8, the second antenna 824 further includes one or more extension rings or regions 840 that extend radially from an outside edge 828 of the second antenna. The extension rings are constructed of non-interfering and/or radio frequency transparent material(s). Wireless communication communicated to and/or from the first antenna 822 passes through the extension rings 840 without interfering or only minimally interfering with the communication signal. The extension rings can be constructed of low loss material, and/or other relevant material that allows wireless communication within at least a desired frequency range to pass. In the design of the extension rings, their electrical properties are accounted for in the design of the first antenna 820. In some preferred embodiments, the extension rings generally have the property of low dielectric loss at the frequency of operation of the first antenna 820. In some embodiments, the extension rings are comprised of thin spokes, with air gaps in between. The one or more extension rings transfer mechanical movement to the second antenna, and thus are rigidly mounted, whether by adhesive bonding, by fastener(s) or other coupling, to the disks 650, 652, 654 of the second antenna 824.

The extension 840 is extended from the outer edge 828 of the second antenna 824 radially to define an outer perimeter or steering edge 842 that is proximate the perimeter 825 of the first antenna 822. This allows the steering system 532 for the second antenna to also be positioned outside the perimeter of the antennas 822, 824. Therefore, the first and second antennas do not have to be placed over the rotational drives, allowing, in some embodiments, for a lower profile 850 for the overall antenna system 820.

The first antenna 822 may include a small hole 860 to allow wiring or other electrical coupling of signals and power to be communicated to and/or from the second antenna 824. The power and/or signals for the first and second antennas 822, 824 are concentrically feed, in some implementations, to the first and second antennas through a single bearing in the center, or at a single swivel joint which may pass multiple signals and power supply lines at the center from a signal controller 870.

The second steering system 532 also can include separate steering mechanisms 540 (e.g., rotational drives, and/or other mechanisms) for each plane (i.e., the turntable 650, elevation plane 652 and polarization plane 654). The steering mechanisms 540 cooperate with the perimeter of the second antenna defined by the outer edge 842 of the extension ring(s). By using the outer perimeter 842 of the second antenna, the steering system 532, in some embodiments, achieves higher accuracy because of the increased circumference of the second antenna allows for smaller rotational changes of the second antenna relative to the angle of rotation of the rotational drive. The steering system 532 rotates the planes of the second antenna to accurately direct the second antenna to transmit and/or receive a beam in a desired direction, and in some implementations with a defined polarization. The communication system 820 allows for independent steering of the first antenna 822 and second antenna 824, through the independent steering systems 530, 532 and steering mechanisms 540.

Figure 9:
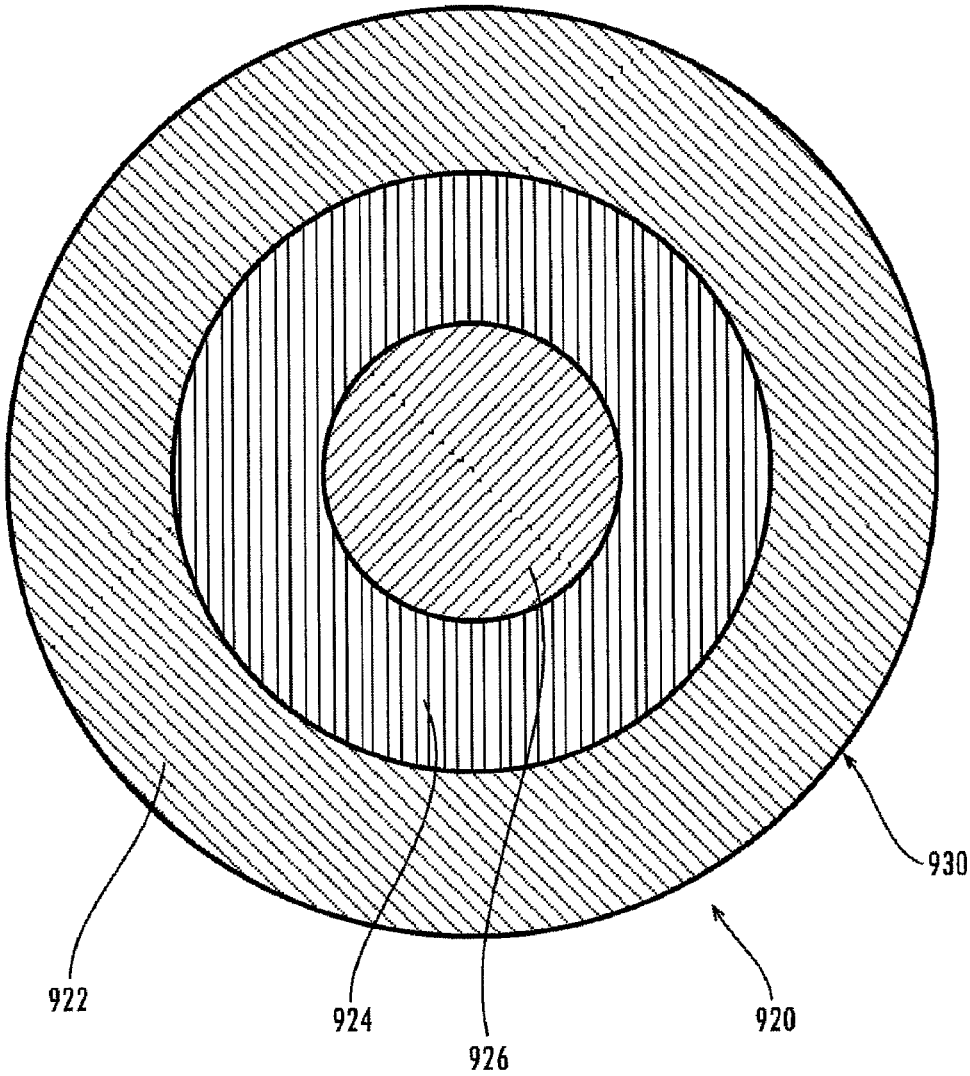
FIG. 9 shows a simplified overhead view of a communication system comprising three concentric antennas.

FIG. 9 shows a simplified overhead view of a communication system 920 comprising three antennas 922, 924, and 926. In some embodiments, the antennas are concentrically positioned. In alternative embodiments one or more of the antennas can be positioned off center and/or eccentric. The first antenna 922 includes an inactive region (not shown) at which the second antenna 924 is positioned. The second antenna also includes an inactive region (not shown) at which the third antenna 926 is positioned. Each antenna is independently steerable. In some embodiments the second and third antennas 924 and 926 include one or more extension rings (similar to that shown in FIG. 8) that extends from perimeters of the antennas out to a steering edge that is about equal with the first antenna perimeter 930.

In some implementations, the first and second antennas 922 and 924 include holes or apertures that at least in part define the inactive regions. Steering mechanisms cooperate with the second and third antennas through the holes of the first and second antennas, respectively. Similarly, power and communication signals can couple with the second and third antennas through the holes in the first and second antennas. In some embodiments, the third antenna provides bidirectional communication, while the first antenna transits wireless communication and the second antenna receives wireless communication. The antennas can be implemented in alternative configurations to achieve desired communications (e.g., first, second and third antennas each provide bidirectional communication; first antenna provided bidirectional communication, while second antenna transmits and third antenna receives; four concentric antennas can be employed; and substantially any relevant configuration). The size of the antenna system 920 and the antennas 922, 924, and 926 can be substantially any relevant size, depending on the desired implementation and/or communication to be achieved. Further, the antenna system 920 can include substantially any number of cooperated antennas.

FIGS. 2-9 have demonstrated antenna systems with the second antenna (and third antenna) positioned generally concentrically with the first antenna such that both antennas rotate about a common axis. Other embodiments, however, provide axes of rotation that differ for one or more of the antennas of a system. For example, the second antenna can be positioned at an inactive region of the first antenna where the inactive region is off center.

Figure 10:
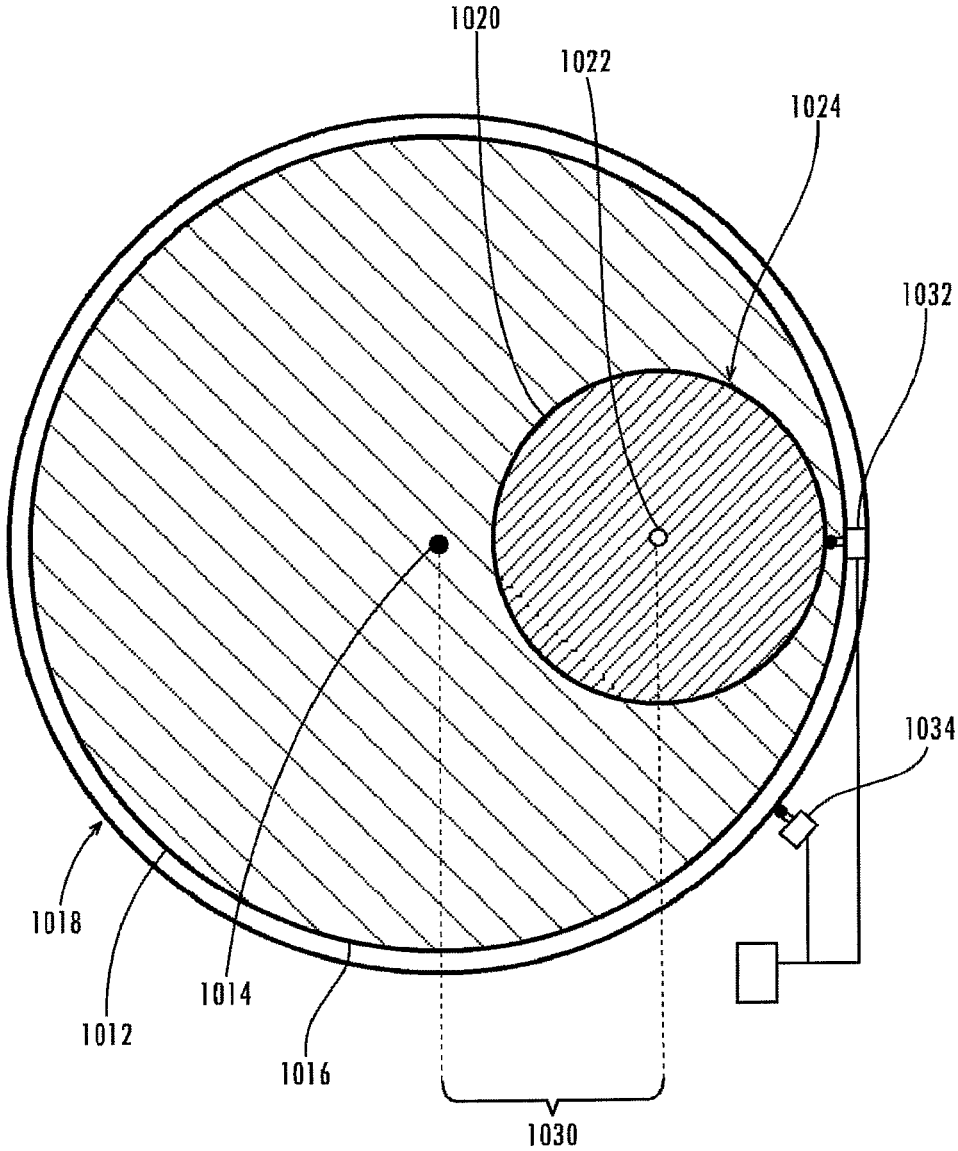
FIG. 10 depicts a simplified overhead view of an antenna system with eccentric first and second antennas.

FIG. 10 depicts a simplified overhead view of an antenna system 1010 with a first antenna 1012 configured to rotate about a first axis 1014, defined generally at a center of the first antenna. The second antenna 1020 is positioned off-center relative to the first antenna, and configured to rotate about a second axis 1022 defined at a center of the second antenna. Thus, the system 1010 provides an eccentric configuration of the antenna positioning. The first and second axes are separated by a distance 1030. For example, the separation 1030 can be such that the perimeter 1024 of the second antenna generally aligns with a perimeter 1016 of the first antenna.

In some embodiments, the off center positioning of the second antenna 1020, at least in part, allows the steering of the second antenna to be controlled through one or more steering mechanisms 1032 positioned at the perimeter of both of the first and second antennas without the steering mechanism being extended through a hole of the first antenna, and without employing extension rings to increase the diameter of the second antenna. This configuration further allows for a lower profile over systems positioning the steering mechanism under the first antenna 1022 and/or second antenna 1020. In some embodiments, the second antenna 1020 and the steering mechanism(s) 1032 of the second antenna are positioned directly on the first antenna, such as directly on a turntable 1018 of the first antenna. One or more steering mechanisms 1034 can cooperate with the first antenna, including the turntable 1018 to adjust antenna characteristics. As the turntable of the first antenna rotates, the second antenna and the steering mechanism 1032 also rotate, allowing the steering mechanism to continue to independently steer the second antenna. In some implementations, the second antenna can be positioned such that a portion of the antenna extends beyond the perimeter of the first antenna.

Figure 11:
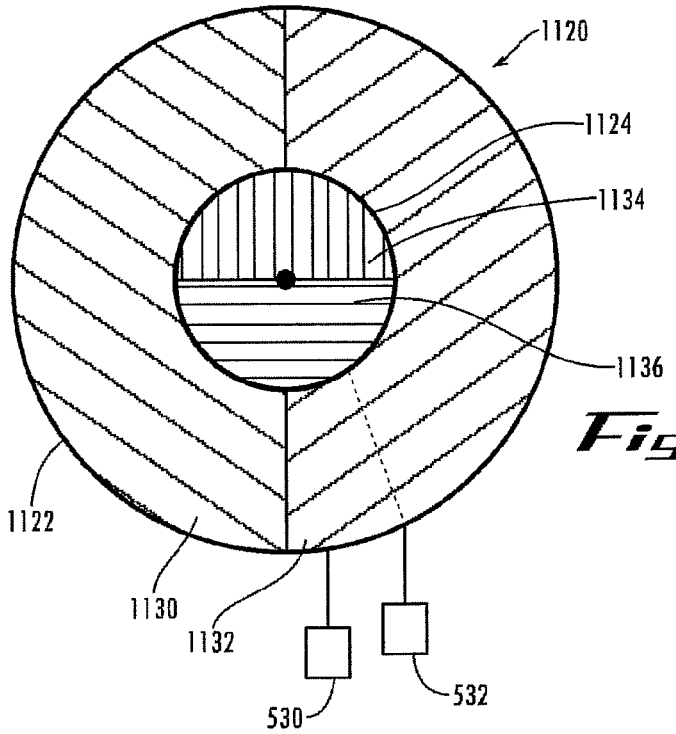
FIG. 11 shows an overhead view of the antenna system similar to that shown in FIG. 2 with linear polarization depicted by cross-hatching.

The present embodiments have been described as allowing for control and/or adjustment of the polarization of the wirelessly communicated beams and/or received beams. The polarization is employed in some implementations with linear polarization. FIG. 11 shows an overhead view of the antenna system 1120 similar to that shown in FIG. 2, with first and second antennas 1122, 1124. The first antenna 1122 has an inactive region and the second antenna 1124 is positioned at the inactive region. The inactive region of the first antenna can be defined by a hole in the antenna and/or gaps in transverse stubs as described above. The antenna system 1120 is configured with the two independently steerable antennas 1122, 1124, with steering control systems 530, 532 for each antenna (however, a single steering control system can be employed to independently steer each antenna). Further, both antennas allow for control systems 530 and 532 to adjust at least a polarization of the antenna to limit the wireless signals communicated from and received by each antenna.

In some embodiments, each beam is divided according to a first and second linear polarization, according to partial elements, such as semicircular elements. Therefore, the antennas can be configured such that each beam is divided into two polarizations, where typically the polarizations are not independently steerable. The system of FIG. 11 shows the first antenna as being divided to provide a beam with two orthogonal linear polarizations 1130, 1132, and the second antenna being similarly divided to provide a beam with two orthogonal linear polarizations, 1134 and 1136, depicted by the orthogonal cross-hatching. This allows each antenna to operate, for example, in applications where accurate polarization alignment is a critical factor in communication, since the polarization is used to reject interfering signals to and from narrowly separated remote sources, such as neighboring satellites in geostationary orbit. The steering system rotates the polarization layer to achieve a desired polarization orientation of the two linear polarizations.

In some alternative embodiments, however, one or both of the antennas can be circularly polarized. With circularly polarized antennas, the steering system does not include a steering mechanism to rotation the polarization layer as the circular polarization typically does not need alignment. The antenna system can be implemented as a concentric and/or eccentric horizontal and vertical ring pair, each with a singular polarization. There are many applications where the compound antenna systems of the present embodiments are employed with one or more antennas being circularly polarized, for example, operations in the Ka band for both their data and television solutions. The present embodiments allow dual antenna systems to operate with both antennas utilizing circular polarization; one to be operating with circular polarization while the other operates in linear polarization; and both to be operating in linear polarization.

Figure 12:
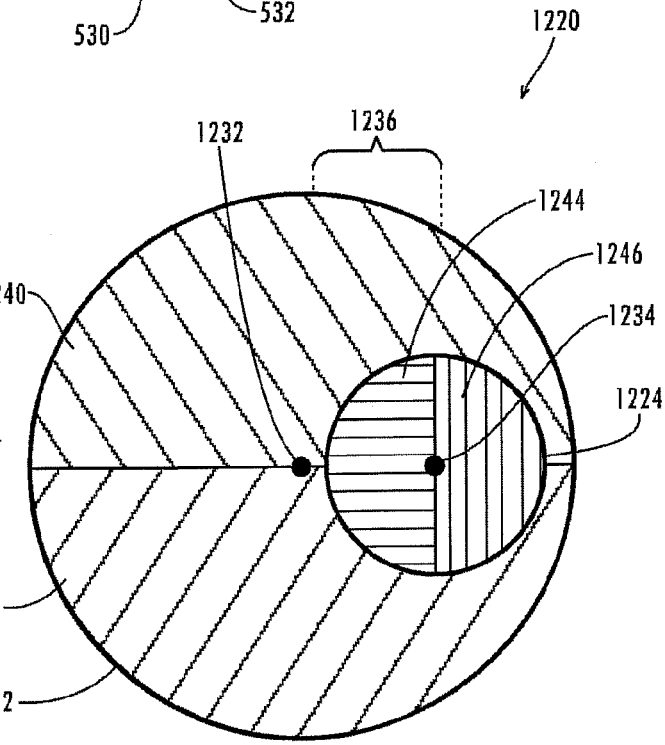
FIG. 12 depicts a simplified overhead view of an eccentric antenna system 1220 according to some embodiments with linear polarization depicted by cross-hatching.

FIG. 12 depicts a simplified overhead view of an eccentric antenna system 1220 according to some embodiments with second antenna 1224 off-center from the first antenna 1222. The rotational axes 1232 and 1234 of the two antennas are separated by a distance 1236, similar to the antenna system of FIG. 10. Each of the antennas is configured with linear polarization. The first antenna 1222 is configured with orthogonal polarization 1240, 1242 depicted by the orthogonal cross-hatching. Similarly, the second antenna 1224 is configured with orthogonal polarization 1244, 1246 depicted by the orthogonal cross-hatching.

Figure 13:
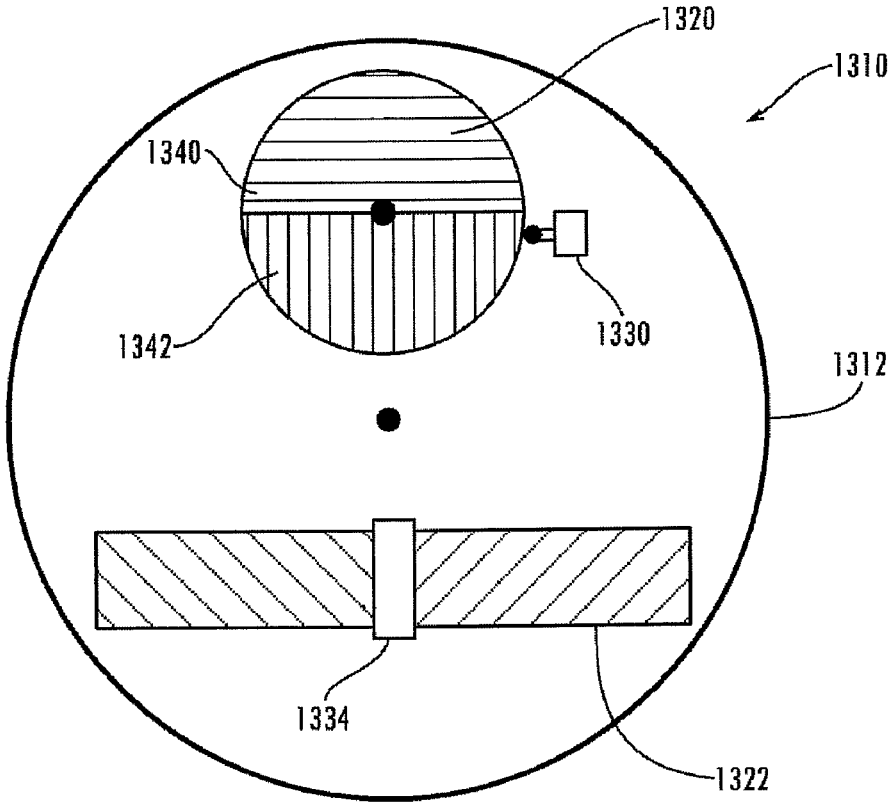
FIG. 13 depicts a simplified overhead view of a wireless communication system according to some preferred embodiments with planar and tiltable antennas.

FIG. 13 depicts a simplified overhead view of a wireless communication system 1310 according to some preferred embodiments. The communication system incorporates two distinct antennas 1320 and 1322 for transmission and/or reception of wireless communications. The system 1310 includes a main turntable 1312 upon which both antennas 1320, 1322 are mounted. The first antenna 1320 is a planar antenna with a low profile, such as a VICTS antenna. This antenna typically includes a separate turntable to be rotated independent of the orientation of the main turntable 1312. The first antenna 1320 further includes, in some embodiments, additional steering and/or polarization controls, such as an elevation plane and a polarization plane that are independently controlled through a steering control system 1330. In some preferred embodiments, the steering control system (including one or more steering mechanism) is also mounted on the main turntable 1312 to simplify the cooperation of the steering system 1330 with the first antenna 1320. The first antenna can be employed with linear polarization, such that the antenna has orthogonal polarization 1340, 1342. Alternatively, in some implementations, the first antenna is employed with a circularly polarized antenna.

The second antenna 1322 is an antenna steerable in elevation, and is implemented through substantially any such type of antenna, including as a tiltable flat panel antenna, a Lumberg lens based antenna, one or more small parabolic dishes, another VICTS type antenna, or other such antennas capable of being steered in elevation. The second antenna includes a tilt table 1334 allowing adjustment of the elevation of the second antenna through the tilt of the tilt table.

Both first and second antennas 1320, 1322 operate with the azimuth established through the rotation of the main turntable 1312. In some embodiments, the azimuth of the first VICTS antenna 1320 is further controlled through additional rotation of its own turntable. As indicated above, the elevation of the second antenna 1322 is controlled through adjustments to the tilt of the tilt table 1334, or by movement of a component of the Lumberg antenna feed, or by relative rotation of plates in a VICTS antenna. The adjustments for elevation for the first antenna 1320 are achieved through the rotation of its elevation plane through conventional means (e.g., through rotation of the elevation plane by steering control system 1330). The system 1310 is shown in FIG. 13 with both antennas within the perimeter of the first turntable 1312. In some implementations, however, one or both of the first and second antennas are positioned with portions extending beyond the perimeter of the first turntable.

The communication system 1310 of FIG. 13 has a broad range of applications. For example, this system can be employed in situations where there is a correlation between the positioning of two different satellites where tracking, and communication with both is desired. The use of the low profile first antenna 1320 avoids interfering in, or only minimally interferes in the communication beam of the second antenna. Therefore, the two antennas can be cooperated to operate independently and point in different directions without a conflict between the two antennas.

The present embodiments provide for low profile antenna communication systems allowing for multiple independently steerable beams. Because of the low profile, these antenna systems can be employed in numerous implementations. For example, the low profile antenna systems of the present embodiments can be utilized on airplanes to provide direct communication with satellites and/or other stationary or mobile communication platforms. By allowing independent steering of the antennas, the systems allow for simultaneous communication with multiple satellites or other communication stations.

Referring back to FIG. 1, the communication systems 110 can be positioned on the fuselage of the airplane within a protective cover 121, such as a radome or other such cover. This allows the systems to be retrofitted onto existing airplanes as well as being incorporated into designs of new airplanes. The communication system is generally positioned on the airplane where objects (birds or other objects that might contact the airplane) are not going to hit and/or damage the system. The low profile and small footprint of the antenna system reduce the amount of space needed on the fuselage of the airplane (and/or allow multiple antennas to be employed in place of other antennas that had larger footprints), with a simplified installation onto the airplane. Further, the planar antennas have a low profile are relatively light weight. Thus, the antenna systems of the present embodiments allow for lower profile radomes 121 to house the system, affect the operation or load of the airplane only to a reduced extent, as compared to other types of antennas of equivalent function.

Additionally, the systems can be scaled to substantially any size depending on the desired application. In some implementations, the communication systems of the present embodiments can replace existing antenna systems employed on some airplanes of commercial airlines, military airplanes and/or private airplanes. For example, an antenna system according to some embodiments can have dimensions for a first, larger antenna with a diameter of about 35 inches. In this configuration, the multi-antenna system can provide independent communication through each antenna, for example, providing transmission and reception of data (e.g., Internet, email, other electronic information, including operating conditions of the airplane and/or passengers) through a first antenna, and receiving and transmitting multimedia content and/or control data (e.g., "Live TV" content, television broadcasts, radio broadcasts, news broadcasts, movies and other such multimedia data and/or controls) through a second antenna.

The communication systems of the present embodiments are not limited to airplanes, but can be employ with substantially any mobile device (such as a car, train, boat or other such mobile devices), and/or can be utilized for stationary communication. As discussed above, the antenna systems of the present embodiments can be scaled for desired applications, such as placements on cars, ships, boats, and other mobile platforms, and can additionally be utilized in station applications (e.g., providing wireless communication of data and/or multimedia content from offices, homes, stadiums, and other facilities). Similarly, the communication systems can communicate with substantially any mobile communication station (e.g., satellites, other airplanes, cars, boats and other similar stations) and/or stationary stations 120 (e.g., ground airport communication stations, stationary dish antennas, other ground stations and the like).

Further, the present embodiments can be employed for communication at substantially any relevant frequency. The antenna systems according to some embodiments can be configured to provide communication in traffic radar frequency bands, military radar bands, international telecommunications union bands and other frequency bands. For example, in some implementations, the antenna systems provide communication over the Ka-band, the Ku-band, the L-band, the S-band and/or other such frequency bands.

While the invention herein disclosed has been described by means of specific embodiments and applications thereof, numerous modifications and variations could be made thereto by those skilled in the art without departing from the scope of the invention set forth in the claims.

What is claimed is:

1. An antenna comprising:

a first variable inclined continuous transverse stub (VICTS) antenna comprising a perimeter and an inactive region defined within the perimeter; and a second VICTS antenna positioned at the inactive region within the perimeter of the first VICTS antenna, wherein the second VICTS antenna is steerable independent of the first VICTS antenna.

2. The antenna of claim 1, wherein the first VICTS antenna comprises an aperture defining at least a portion of the inactive region, and the second VICTS antenna is positioned at the aperture of the first VICTS antenna.

3. The antenna of claim 1, wherein the first VICTS antenna comprises a plurality of stub elements extending across a least a portion of the first VICTS antenna, where each of the plurality of stub elements have gaps separating first portions from second portions of the plurality of stub elements such that the gaps at least in part define the inactive region of the first VICTS antenna.

4. The antenna of claim 3, wherein the first VICTS antenna further comprises a plurality of non-radiating connectors where each of the plurality of non-radiating connectors electrically couples with a first portion and a second portion of one of the plurality of stub elements.

5. The antenna of claim 4, wherein the plurality of non-radiating connectors extend around a perimeter of the inactive region.

6. The antenna of claim 1, wherein the second antenna comprises an extension ring extending from a perimeter of the second antenna and defining a extension ring perimeter a distance from the perimeter of the second antenna that is proximate to the perimeter of the first antenna.

7. The antenna of claim 1, further comprising:

a third VICTS antenna comprising a perimeter and an inactive region defined within the perimeter of the third antenna such that the first antenna is positioned at the inactive region of the third antenna.

8. The antenna of claim 1, wherein the first antenna transmits and receives wireless data communication and the second antenna transmits and receives wireless multimedia communication.

9. A method, comprising:

steering a first variable inclined continuous transverse stub (VICTS) antenna in response to receiving a first control signal, the VICTS antenna comprising a perimeter and an inactive region defined within the perimeter; and steering a second VICTS antenna in response to receiving a second control signal, the second VICTS antenna being positioned at the inactive region within the perimeter of the first VICTS antenna.

10. The method of claim 9, further comprising steering the first VICTS antenna independent of the second VICTS antenna.

11. The method of claim 9, further comprising communicating with a first remote communication system via the first VICTS antenna, and communicating with a second remote communication system via the second VICTS antenna.

12. The method of claim 9, further comprising utilizing a first steering system to steer the second VICTS antenna, the first steering system comprising first, second and third rotational drives cooperated with the perimeter of the second antenna to control azimuth, elevation and polarization characteristics of the second antenna.

13. The method of claim 9, further comprising utilizing a second steering system to steer the first VICTS antenna, the second steering system comprising fourth, fifth and sixth rotational drives cooperated with the perimeter of the first antenna to control azimuth, elevation and polarization characteristics of the first antenna.

14. The method of claim 9, further comprising steering a third VICTS antenna in response to receiving a third control signal, the third VICTS antenna comprising a perimeter and an inactive region defined within the perimeter of the third antenna such that the first antenna is positioned at the inactive region of the third antenna.

15. The method of claim 14, further comprising steering the third antenna independent of the first antenna and the second antenna.

16. A method, comprising:

providing a first turntable having a perimeter;

securing a first antenna having a perimeter on a first surface of the first turntable; and positioning a second antenna comprising a second turntable at a location proximate the first antenna such that at least a portion of the second antenna is positioned to extend within the perimeter of the first turntable, wherein the second antenna is steerable independent of the first antenna.

17. The method of claim 16, comprising providing an enclosure that encloses and protects the first turntable, the first antenna, the second turntable, and the second antenna from the environment.

18. The method of claim 16, further comprising positioning the second antenna at an inactive region of the first antenna, the inactive region being defined within the perimeter of the first antenna.

19. The system of claim 16, further comprising:

providing a first rotational drive coupled with the second turntable to adjust rotational positioning of the second antenna;

providing a second rotational drive coupled with the second antenna to adjust a first characteristic of the second antenna;

providing a third rotational drive coupled with the first turntable to adjust the positioning of the first turntable; and providing a fourth rotational drive coupled with the first antenna to adjust a first characteristic of the first antenna.

20. The method of claim 19, further comprising:

providing a fifth rotational drive coupled with the first antenna to adjust a polarization of the first antenna;

providing a sixth rotational drive coupled with the second antenna to adjust a polarization of the second antenna; and wherein the first characteristic of the first antenna comprises an elevation at which that first antenna is directed such that the fourth rotational drive adjusts the elevation of the first antenna, and the first characteristic of the second antenna comprises an elevation at which that second antenna is directed such that the second rotational drive adjusts the elevation of the second antenna.

* * * * *